US005440107A

United States Patent [19]

Phillips

[11] Patent Number: 5,440,107

[45] Date of Patent: Aug. 8, 1995

[54] METHOD AND APPARATUS FOR AN IMPROVED MONEY DRAWER ASSEMBLY WITH MONEY CLIP ALARM SYSTEM

[75] Inventor: Jimmy R. Phillips, Garland, Tex.

[73] Assignee: Texas Instruments Incorporated, Dallas, Tex.

[21] Appl. No.: 145,265

[22] Filed: Oct. 29, 1993

[51] Int. Cl.[6] ..... G07G 1/00

[52] U.S. Cl. ..... 235/10; 235/128; 340/570; 340/571

[58] Field of Search ..... 235/7 R, 22, 10, 23, 235/128; 364/405; 340/570, 571

[56] References Cited

U.S. PATENT DOCUMENTS

| | | | |
|---|---|---|---|
| 3,569,644 | 3/1971 | Brugger et al. | 340/570 |
| 3,725,893 | 4/1973 | Malta et al. | 340/570 |
| 4,035,792 | 7/1977 | Price et al. | 235/22 X |
| 4,829,429 | 5/1989 | Komai et al. | 235/22 X |

*Primary Examiner*—Richard A. Wintercorn
*Assistant Examiner*—Patrick J. Stanzione
*Attorney, Agent, or Firm*—Tammy L. Williams; Richard L. Donaldson

[57] ABSTRACT

Embodiments of improvements to a money clip alarm system of a cashier's drawer are disclosed. In one embodiment, a terminal contact block device is mounted to the drawer tray and a non-shorting feed through spring contact block device is mounted to the drawer housing. When the contact block devices are not touching, the electrical path from the money clip to the remote alarm automatically disconnects allowing convenient removal of the drawer tray from the drawer housing. A second embodiment includes a push button switch which changes state when the drawer tray is removed from the drawer housing providing an alternative electrical path from the drawer housing to the remote alarm and preventing activation of the remote alarm system. The preferred embodiment includes a magnetic switch in place of the push button switch mounted between the drawer tray and the drawer housing. Further, a delaying circuit is added to the alarm circuit which prevents immediate activation of the remote alarm when the drawer tray is removed allowing the magnetic switch to activate and also preventing immediate activation of the remote alarm when the money is removed from the money clip accidentally, allowing the employee a few seconds to replace it. One preferred embodiment also includes a shorting feed through spring contact block device in place of the non-shorting feed through spring contact block device which also provides an alternative electrical path when the drawer tray is removed.

24 Claims, 5 Drawing Sheets

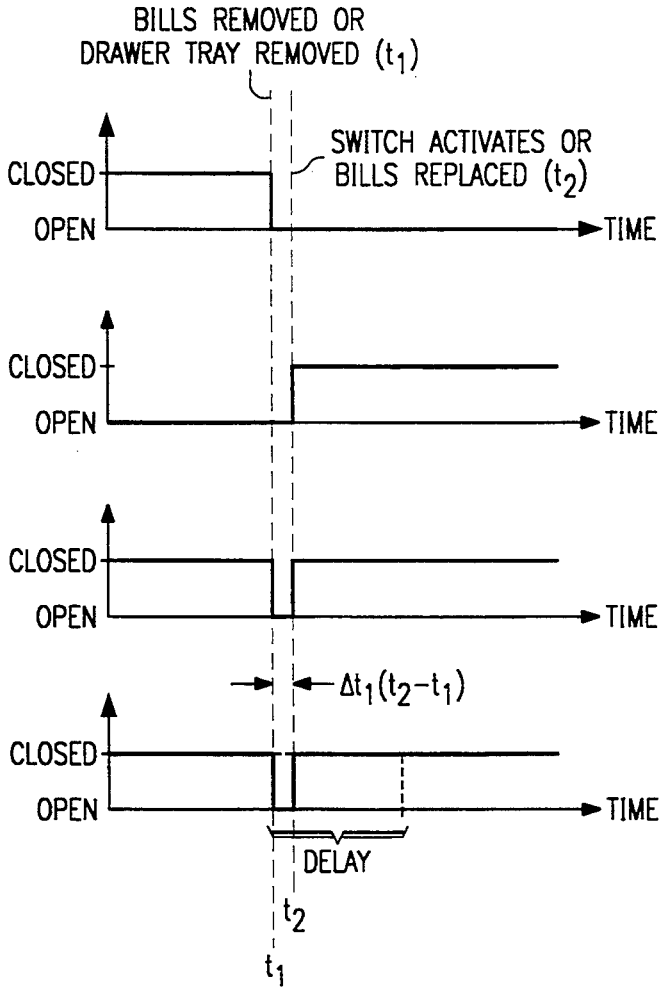
FIG. 6A
FIG. 6B
FIG. 6C
FIG. 6D
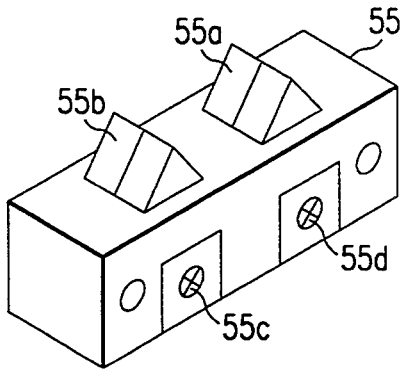
FIG. 7A
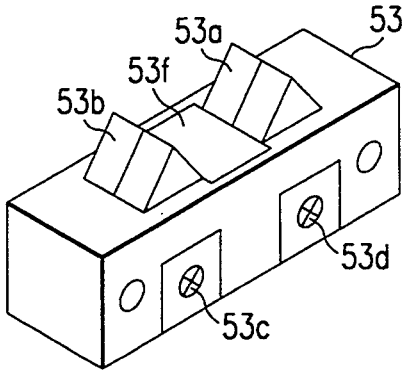
FIG. 7B

METHOD AND APPARATUS FOR AN IMPROVED MONEY DRAWER ASSEMBLY WITH MONEY CLIP ALARM SYSTEM

TECHNICAL FIELD OF THE INVENTION

This invention relates to a cashier's drawer and more particularly to a money drawer assembly which includes a money clip connected to a remote alarm whereby the remote alarm is automatically initiated when bills contained in the money clip are removed.

BACKGROUND OF THE INVENTION

In numerous situations, a business must supply it's employees with cash for handling day-to-day operations. Usually the money is kept in a cashier's drawer conveniently placed for the employee's use but frequently in a place highly visible to the customer. Therefore in all of these businesses, a common concern is robbery. At any time a robber may approach the employee and present a gun and a note, or oral instructions, demanding that the employee hand over all of the cash in the employee's possession. The employee usually has ready access only to the cash in the employee's drawer which limits the amount of money stolen. But in most situations, even with the installation of video cameras recording the event, no one else may be aware of the fact that the employee is being robbed so that help can be dispatched as soon as possible.

Several solutions have been tried to address this problem. One solution was to provide a 'panic' button close to the employee so that it may be activated by the employee when approached by a suspected robber. This solution, however, requires the employee's active participation at a time when the employee may be frightened and disoriented and thus likely to forget even a well rehearsed procedure. The employee may even be completely incapacitated before activating the alarm. Or, more commonly, the robber may insist that the employee back away from the money tray, place their hands on the counter top, then carefully pull the cash out of the drawer while the robber watches to make sure that the employee does not activate the panic button with their knee or hand.

The current state of the art attempts to correct these problems by providing the cashier's drawer with an alarm that will activate automatically when the employee, or anyone else, removes money from an inconspicuous money clip inside the drawer and hands it over to the robber. It provides for a tray assembly which sits on top of a false bottom to the enclosing drawer housing. The tray assembly includes two bill/coin trays which sit inside a drawer tray. A money clip lying inside one of the bill/coin trays incorporates a switch, i.e. a standard mechanical switch, and is connected at one end to a cable terminating in a connector which connects to a plug or jack mounted somewhere inside the drawer housing (usually by the alarm company). The plug or jack is in turn connected to a closed loop panic alarm so that when money contained in the money clip is removed, a remote alarm system is automatically and immediately activated. One particular cashier's drawer uses an RJ-7 modular telephone connector and an RJ-7 modular telephone jack.

Although the current art is an improvement over the panic alarm button, several other problems still persist. The first problem is in removing the tray assembly. Although the bill/coin trays actually contain the money, the bill/coin trays and drawer tray are usually removed together as one unit, the tray assembly. When the employee needs to remove the tray assembly, i.e. to go on break, the employee must first disconnect the money clip from the RJ-7 modular telephone jack. To do this, however, the employee must pull the sometimes heavy tray assembly almost completely from the drawer opening and balance it with one hand while disconnecting the money clip with the other. Furthermore, removing the tray assembly, even for a brief period of time, also activates the remote alarm system. The employee must call security (or an alarm monitoring company) either before the tray assembly is removed or after the alarm has been activated to prevent or cancel any help dispatched because of the false alarm.

Maintenance is a second problem with the money drawer assembly of the prior art. If the employee forgets and attempts to remove the tray assembly without first disconnecting the money clip, the RJ-7 telephone connector and jack are ripped apart, the connector is destroyed and must be replaced. Also, when the tray assembly is removed it is usually placed in a pigeon-hole slot in a vault. When placing the tray assembly into this slot, there is the possibility of the wires or connectors becoming cut or entangled in the process, requiring additional maintenance. Even if the employee remembers to disconnect the money clip before removing the tray assembly, the connector must be replaced periodically to ensure a tight connection with the jack because of the wear upon the RJ-7 telephone connector caused by the frequent connections to and disconnections from the telephone jack.

A third problem with the prior art is the loss of bills and/or coins between the bill/coin trays and the drawer tray. Two bill/coin trays sit inside the drawer tray. But, because the two bill/coin trays do not use all of the space provided in the drawer tray, there are gaps left between the sides of the trays into which bills and coins sometime fall. The employee may not even be aware of the loss until the end of the day when their money count is out of balance. The employee must then dismantle the tray assembly to retrieve the lost money.

In light of these considerations, it is a primary objective of the present invention to provide an improved cashier's drawer which does not suffer from the problems mentioned above with respect to the prior art.

SUMMARY OF THE INVENTION

In accordance with one preferred embodiment of the present invention, one or more of the problems mentioned above with respect to the prior art are resolved in the present invention which provides for a cashier's drawer with a money clip connected to a remote alarm system through contacts mounted between the drawer tray and the drawer housing.

These and other features of the invention will be apparent to those skilled in the art from the following detailed description of the invention, taken together with the accompanying drawings.

DESCRIPTION OF THE DRAWINGS

FIG. 6 is a timing diagram of a delaying circuit;

FIG. 7*a* is a perspective view of a contact device which is a non-shorting feed through spring contact block device; and FIG. 7*b* is a perspective view of another contact device which is a shorting feed through spring contact block device.

DETAILED DESCRIPTION OF THE INVENTION

A cashier's drawer of the type commonly used includes a drawer assembly electrically connected to a remote alarm system through a money clip alarm system.

Figure 1:
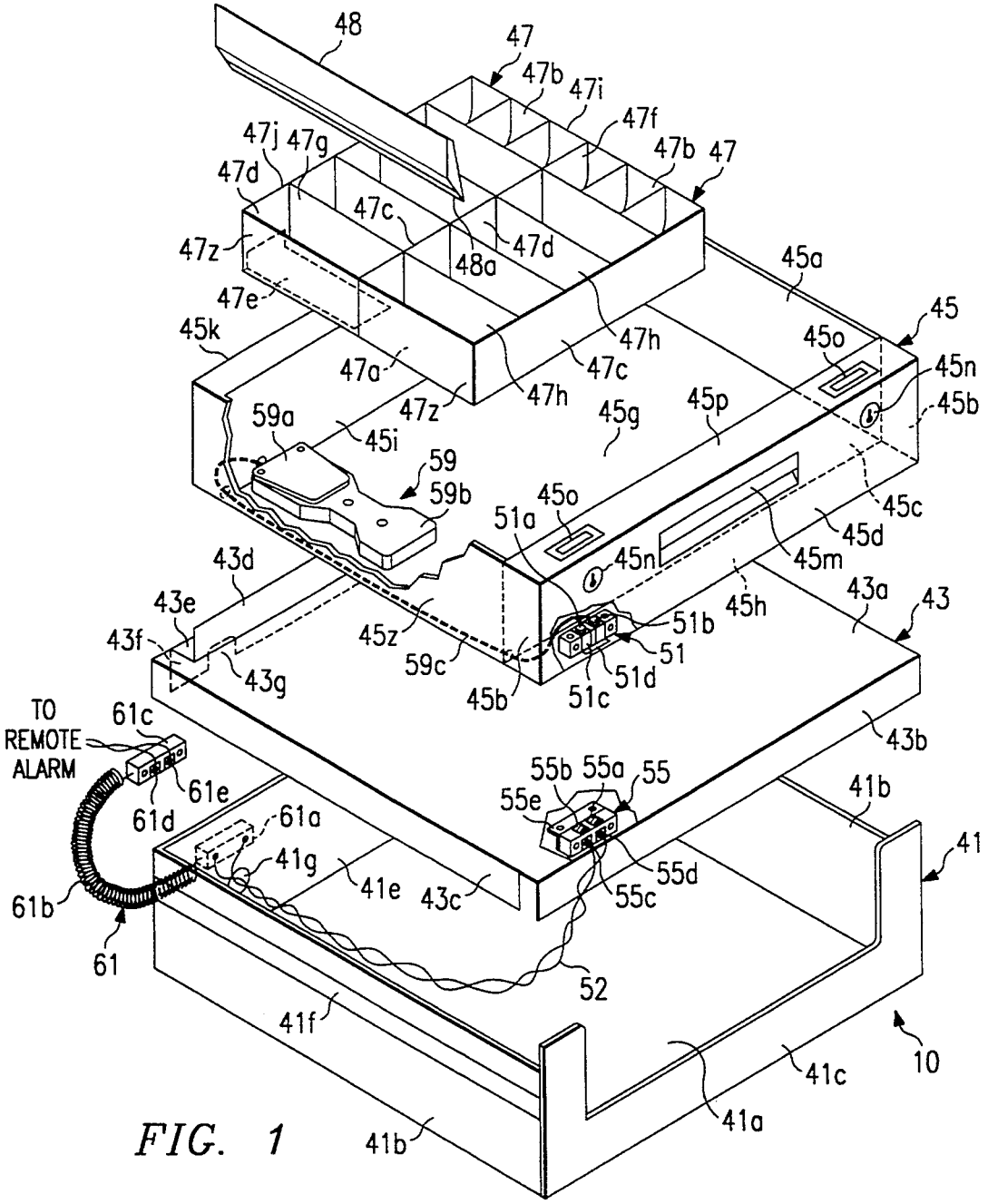
FIG. 1 is an exploded perspective view of the cashier's drawer in accordance with one embodiment of the present invention.

FIG. 1 shows a cashier's drawer according to one embodiment of the instant invention. The cashier's drawer 10 includes a drawer housing 41, a false bottom 43 which is positioned inside the drawer housing 41, a drawer tray 45 which is positioned atop the false bottom 43, and two bill/coin trays 47 which are positioned inside the drawer tray 45. The drawer housing 41 includes a floor 41*a*, sides 41*b*, front wall 41*c* and back wall 41*e*. Guide tracks 41*f* are on the side walls 41*b*. The false bottom 43 has a floor 43*a*, a front flange 43*b*, side flanges 43*c*, a back upper flange 43*d*, and a back lower flange 43*f*. The back upper flange 43*d* extends up from the floor 43*a*. All other flanges 43*b*, 43*c* and 43*f* extend down from the floor 43*a*. When the cashier's drawer is completely assembled, the false bottom 43 sits inside the drawer housing 41 with flanges 43*b*, 43*c*, and 43*f* extending down toward the floor 41*a* leaving a space between the floor 43*a* and the floor 41*a*.

The drawer tray 45 has a front outer wall 45*d*, a front inner wall 45*c*, a back outer wall 45*k*, a back inner wall 45*i*, a left side 45*z* and a right side 45*a*. The drawer tray 45 is positioned inside the drawer housing 41 on the floor 43*a* of the false bottom 43 with it's back outer wall 45*k* positioned against the back upper flange 43*d* of the false bottom 43. The back upper flange 43*d* prevents the drawer tray 45 from being pushed too far back on the false bottom 43. The front inner wall 45*c* is positioned behind the front outer wall 45*d* by sides 45*b* leaving a space 45*h* between the front outer wall 45*d* and the front inner wall 45*c*. A drawer handle 45*m* and key locks 45*n* are located on the front outer panel 45*d*. When a key is placed in the key locks 45*n* and turned, locking plates (not shown) extend up from the openings 45*o* in the upper edge facing 45*p* of the drawer tray 45 to secure the drawer tray 45 to a cashier's pedestal (not shown) or to a vault (not shown) when the drawer tray 45 is removed. The left and right sides 45*z* and 45*a* respectively of the drawer tray 45 fit between the side walls 41*b* and the front and back walls 41*c* and 41*e* respectively of the drawer housing 41.

Each of the bill/coin trays 47 includes a floor 47*a*, a left side 47*z*, a right side 47*b*, a front wall 47*c*, a back wall 47*d*, and dollar bill and coin dividers 47*g* and 47*f* respectively forming bill and coin holding sections 47*h* and 47*i* respectively. One bill holding section 47*j* of one of the bill/coin trays 47 includes a back wall 47*d* and has a rectangular cut-out 47*e* that extends horizontally along the floor 47*a*. The rectangular cut-out 47*e* further extends up the back wall 47*d* of the bill holding section 47*j*. The two bill/coin trays 47 are positioned side by side inside the drawer tray 45 on the floor 45*g* and fit inside the left side wall 45*z*, the right side wall 45*a*, the front inner wall 45*c* and the back inner wall 45*i* of the drawer tray 45. A bill tray spacer 48 fits inside the drawer tray 45 between the left side wall 45*z* of the drawer tray 45 and the left side walls 47*z* of the two bill/coin trays 47. The bill tray spacer 48 tightens the fit of the two bill/coin trays 47 inside the drawer tray 45 to prevent bills and coin from slipping inside.

Figure 5A:
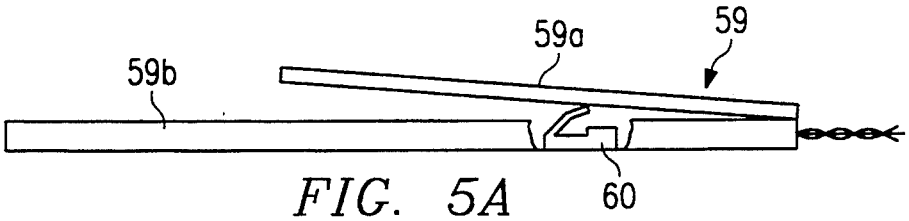
FIG. 5A (PRIOR ART)
FIG. 5*a* is a side view of a money clip with no bait money inserted.
Figure 5B:
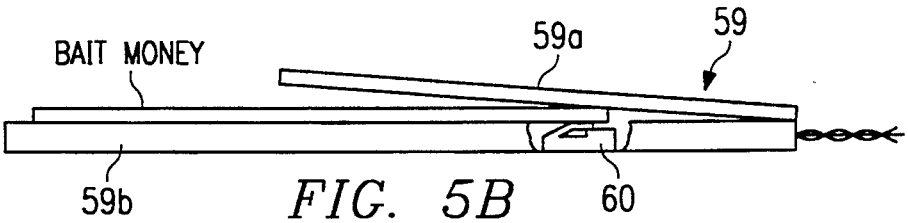
FIG. 5B (PRIOR ART)
FIG. 5*b* is a side view of a money clip with bait money inserted.
Figure 5C:
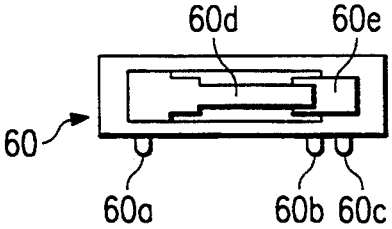
FIG. 5C (PRIOR ART)
FIG. 5*c* is a top view of a switch which is a standard spring loaded mechanical switch.

The money clip alarm system which electrically connects the drawer assembly to a remote alarm system includes a money clip 59 mounted to the floor 45*g* of the drawer tray 45 and protruding up through the rectangular cutout 47*e* in one of the two bill/coin trays 47. The money clip 59 includes a lip 59*a*, a base 59*b* and a standard mechanical spring loaded switch (not shown). Bait money contained in the money clip 59 is placed between the lip 59*a* and the base 59*b*. FIG. 5*a* shows a side view of the money clip 59 and standard mechanical spring loaded switch 60 without bait money inserted. FIG. 5*b* shows a side view of the money clip 59 and standard mechanical spring loaded switch 60 with bait money inserted. FIG. 5*c* is a top view of the standard spring loaded mechanical switch 60 showing the three leads: normally open 60*a*, normally closed 60*b*, and common 60*c*. The standard spring loaded mechanical switch 60 further includes an actuator lever 60*d* and an electrical contact plate 60*e*.

With no bills inserted, the standard spring loaded mechanical switch is in the normally open position, FIG. 5*a*, the common lead 60*c* and the normally open lead 60*a* are connected to the closed loop alarm system, and the state of the switch is open which activates the remote alarm. With bill inserted, FIG. 5*b*, the actuator lever 60*d* touches the electrical contact plate 60*e*, the normally closed lead 60*b* and common lead 60*c* are connected to the closed loop alarm system, and the state of the switch is closed which prevents activation of the remote alarm. The money clip used in this and most other embodiments in this invention is made by United Security Products, Inc., 2171 Research Dr., Livermore, Calif. 94550. The part number is HUC-1 (which includes one switch) or part number HUC-2B (which includes two switches, one for auxiliary use) although other money clips may be utilized as well.

Figure 4:
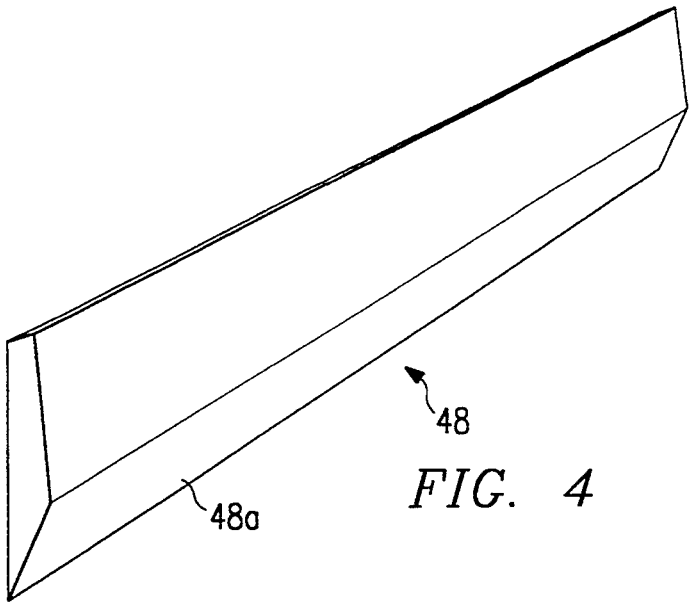
FIG. 4 is a perspective view of the bill tray spacer.

In the instant invention, a non-shorting feed through spring contact block device 55 and a terminal contact block device 51 replace the cumbersome, problem-causing RJ modular telephone connector and jack of the prior art. The terminal contact block device 51 is mounted to the floor 45*g* of the drawer tray 45 in the space 45*h* between the front inner wall 45*c* and the front outer wall 45*d*. The terminal contact block device 51 has a pair of separated contact elements 51*c* and 51*d* which extend through an opening in the floor 45*g* between the front inner wall 45*c* and the front outer wall 45*d*, and a pair of terminals 51*a* and 51*b* each of which is electrically connected to one of the insulated wires of a pair of wires 59*c* from the money clip 59. The pair of wires 59*c* run between the bill tray spacer 48 and the left side wall 45*z* of the drawer tray 45 and are protected by a bevel cut 48*a* in the bill tray spacer 48. A perspective view of the bill tray spacer is shown in FIG. 4.

The non-shorting feed through spring contact block device 55 with a pair of separated contact springs 55*a* and 55*b* and a pair of terminals 55*c* and 55*d* is mounted to the floor 43*a* of the false bottom 43 in the space between the floor 43*a* and the floor 41*a* via an angle bracket 55*e*. The terminal contact block device 51 and the non-shorting feed through spring contact block device 55 create an electrical connection through the drawer tray 45 and the false bottom 43 when the drawer tray 45 is placed on the base 43*a* of the false bottom 43 in the drawer housing 41 and the pair of separated contact springs 55*a* and 55*b* touch the pair of separated contact elements 51*c* and 51*d* of the terminal contact block device 51. A perspective view of the non-shorting feed through spring contact block device 55 is shown in FIG. 7*a*. A coil cord assembly 61 including a first coil cord terminal block device 61*a*, a coil cord 61*b* and a second coil cord terminal block device 61*c* electrically connects the non-shorting feed through spring contact block device 55 to the remote alarm system. The terminals 55*c* and 55*d* of the non-shorting feed through spring contact block device 55 are electrically connected to a pair of terminals (not shown) at the first coil cord terminal block device 61*a* via a pair of insulated wires 52. The pair of wires 52 connected to the pair of terminals 55*c* and 55*d* of the non-shorting feed through spring contact block device 55 extend down into the space between the floor 43*a* of the false bottom 43 and the floor 41*a* of the drawer housing 41.

The first coil cord terminal block device 61*a* is mounted to the back outer wall 41*e* of the drawer housing 41. The pair of wires 52 extend from the non-shorting feed through spring contact block device 55 into the space between the floor 43*a* and the floor 41*a* through a cut-out 43*g* in the back lower flange 43*f* and through an aperture 41*g* in the back outer wall 41*e* of the drawer housing. The pair of wires 52 are then connected to the first coil cord terminal block device 61*a*. The first coil cord terminal block device 61*a* is also electrically connected to a second coil cord terminal block device 61*c* via a coil cord 61*b* which includes a pair of insulated wires. The coil cord assembly 61 allows the entire drawer assembly 10 to be pulled open without disrupting the electrical connection between the first coil cord terminal block device 61*a* and the second coil cord terminal block device 61*c*. The second coil cord terminal block device 61*c*, which may be mounted to the cashier's pedestal, electrically connects the entire drawer assembly to the remote alarm system.

The terminal contact block device 51 and the non-shorting feed through spring contact block device 55 used in this and most other embodiments in this invention are made by Sentrol Inc., 10831 S. W. Cascade Blvd., Portland, Oreg. 97223. The part number is 3506T but other equivalent parts may be substituted. The coil cord assembly 61 was ordered from Ademco Distribution, 2425 Arbuckle Ct, Dallas, Tex. 75229. The part number is 65WH. The angle bracket 55*e* is a $\frac{3}{4}''\times\frac{3}{4}''\times\frac{1}{8}''\times 15''$ long 90° angle bracket made from $\frac{3}{4}''\times\frac{3}{4}''\times\frac{1}{8}''\times 5'$ long 90° standard aluminum angle stock. Other equivalent parts may be substituted for the ones used.

Figure 2:
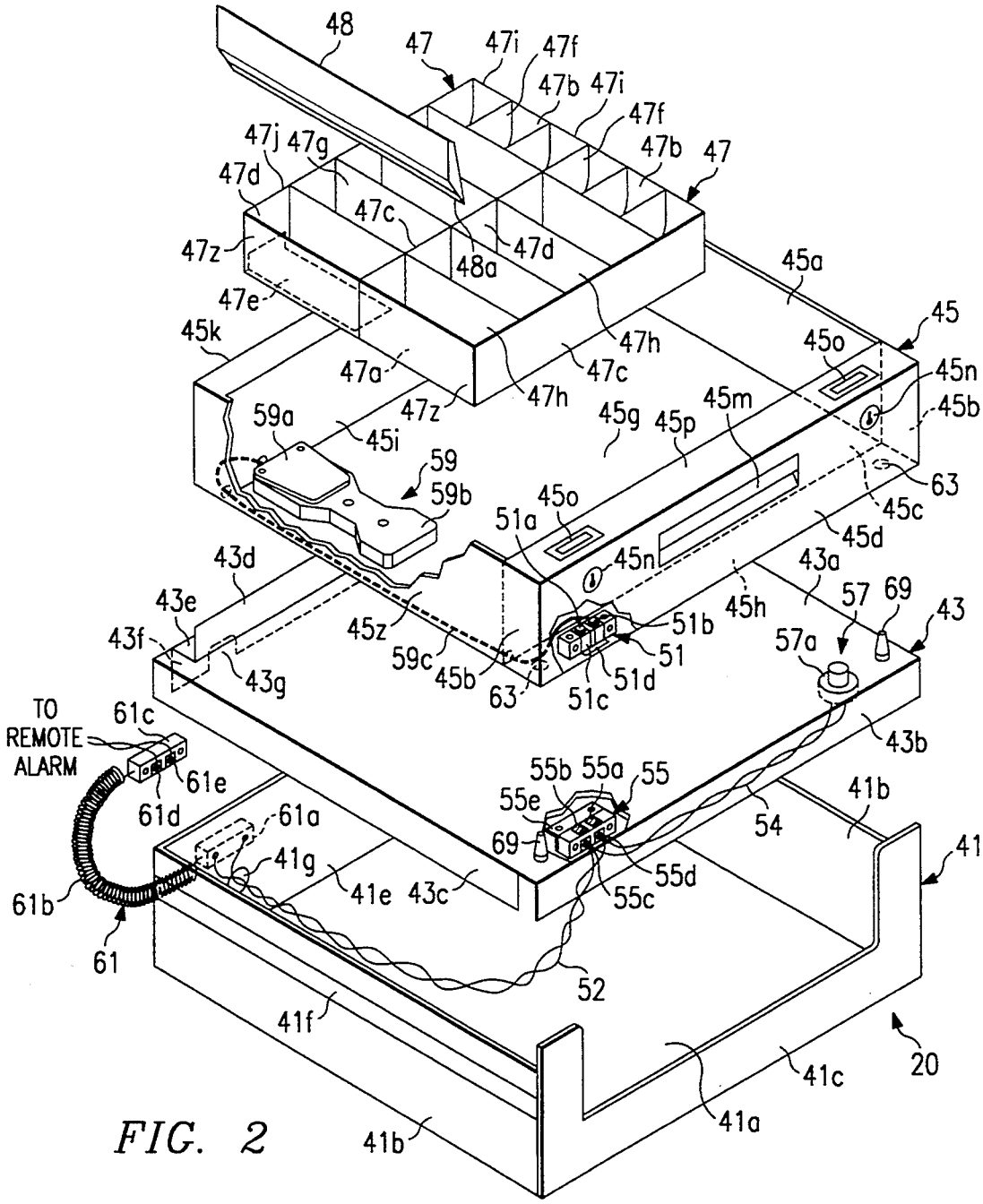
FIG. 2 is an exploded perspective view of the cashier's drawer in accordance with another embodiment of the present invention.

FIG. 2 shows a second embodiment of a cashier's drawer according to the instant invention. The same reference numerals are used to refer to the same elements of FIG. 1 in FIG. 2. Mounted to the floor 43*a* of the false bottom 43 of the cashier's drawer 20 is a push button switch 57 with a push button 57*a*. The push button switch 57 is electrically connected to the non-shorting feed through spring contact block device 55 via a pair of insulated wires 54. One wire of the pair of wires 54 is connected to the first separated contact spring 55*c* and the other wire is connected to the second separated contact spring 55*d*. The push button 57*a* extends through an opening in the floor 43*a* of the false bottom 43 and sits flush with the floor 43*a* when the drawer tray 45 is placed within the drawer housing 41.

When the drawer tray 45 is properly positioned on the floor 43*a* of the false bottom 43, the push button switch 57 is normally open and does not interrupt the electrical connection from the money clip 59 to the remote alarm system. However when the drawer tray 45 is removed, the push button 57*a* extends and closes the push button switch 57 (like the light switch in a refrigerator when the door is opened), providing an alternative closed electrical path from the remote alarm system and preventing the remote alarm system from activating. Replacing the drawer tray 45 causes the push button 57*a* to be depressed opening the push button switch 57 and the electrical path from the money clip 59 to the remote alarm system is restored provided that the drawer tray 45 is placed so that the pair of separated contact springs 55*a* and 55*b* of the non-shorting feed through spring contact block device 55 are touching the pair of separated contact elements 51*c* and 51*d* of the terminal contact block device 51. The push button switch 57 used in this embodiment is a $\frac{3}{4}$ A, 125 V momentary contact refrigerator switch made by Serva-A-Lite, E. Moline, Ill. 61244 part number 8423K1 although an equivalent part may be substituted.

This embodiment of the instant invention also includes guidepin holes 63 drilled in the floor 45*g* of the drawer tray 45 in the space 45*h* between the front inner wall 45*c* and the front outer wall 45*d*. Guidepins 69 are mounted to the floor 43*a* of the false bottom 43 and extend up from the floor 43*a* of the false bottom 43 to fit into guidepin holes 63 along the floor 45*g* of the drawer tray 45. The guidepins 69 ensure proper alignment of the drawer tray 45 thus facilitating proper alignment of the pair of separated contact elements 51*c* and 51*d* of the terminal contact block device 51 with the pair of separated contact springs 55*a* and 55*b* of the non-shorting feed through spring contact block device 55.

Figure 3:
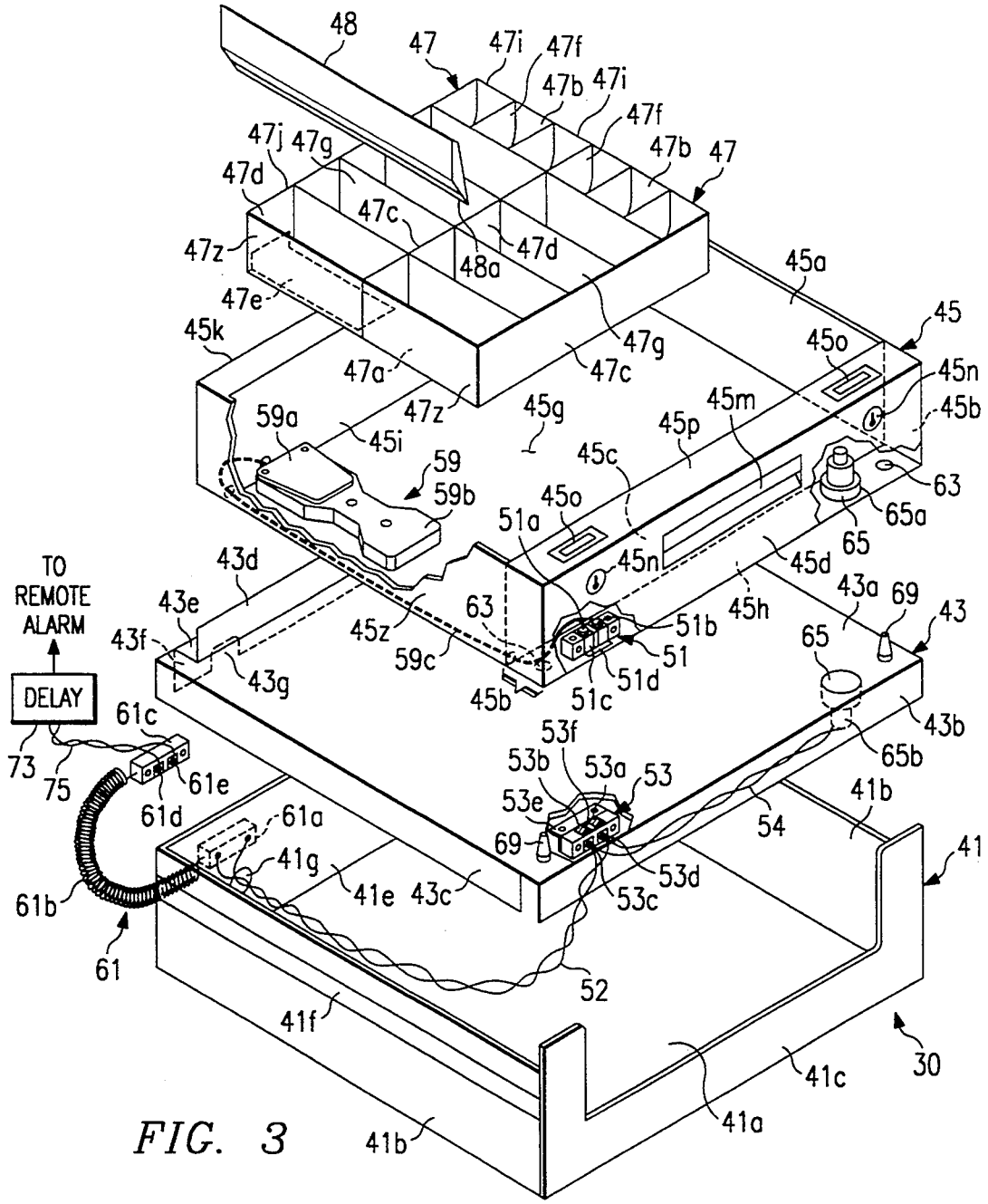
FIG. 3 is an exploded perspective view of the preferred embodiment of the cashier's drawer as constructed according to the present invention.

The preferred embodiment of the instant invention is shown in FIG. 3. The same reference numerals are used in FIG. 3 to refer to the same elements of FIG. 1 and FIG. 2. The cashier's drawer 30 includes a magnetic switch 65 made up of a magnet half 65*a* and a magnetically activated switching half 65*b* mounted between the drawer tray 45 and the false bottom 43. The magnet half 65*a* is mounted to the floor 45*g* of the drawer tray 45 in the space 45*h* between the front inner wall 45*c* and the front outer wall 45*d*. The surface of the magnet half 65*a* extends through an opening in the floor 45*g* and is flush with the floor 45*g*. The magnetically activated switching half 65*b* is mounted to the floor 43*a* of the false bottom 43 in the space between the floor 41*a* and the floor 43*a*. The surface of the magnetically activated switching half 65*b* extends through an opening in the floor 43*a* of the false bottom 43 and is flush with the floor 43*a*.

The magnetically activated switching half 65*b* is electrically connected to the non-shorting feed through spring contact block device 55 via a pair of insulated wires 54. One wire is connected to one of the pair of separated contact springs 55*a* of the non-shorting feed through spring contact block device 55 and the other wire is connected to the other of the pair of separated contact springs 55*b*. When the drawer tray 45 is placed inside the drawer housing 41, the magnet half 65*a* touches the magnetically activated switching half 65*b* and the magnetically activated switching half 65*b* opens. When the drawer tray 45 is removed, the magnet half 65*a* is no longer touching or providing a strong magnetic field to the magnetically activated switching half 65*b*, the magnetically activated switching half 65*b* closes, and an alternative closed electrical path is created between the remote alarm system and the drawer housing 41 preventing the remote alarm system from activating. The guidepins 69 and guidepin holes 63 also ensure that the surface of the magnet half 65*a* is in contact with the surface of the magnetically activated switching half 65*b* when the drawer tray 45 is placed inside the drawer housing 41. The magnetic switch 65 shown is a Sentrol magnetic switch, part number 1076C or equivalent.

The preferred embodiment also includes a delay circuit 73 coupled between the second coil cord terminal block device 61*c* and the remote alarm system. The delay circuit 73 is electrically connected to the second coil cord terminal block device 61*c* via a pair of insulated wires 75. As shown in the timing diagram of the closed loop circuit from the money clip 59 to the remote alarm in FIG. 6*a*, if the bait money is removed from the money clip 59 or if the drawer tray 45 is removed from the drawer housing 41, the closed loop circuit opens, activating the alarm, at time $t_1$. FIG. 6*b* shows the timing diagram of a switching mechanism which closes preventing activation of the remote alarm when the drawer tray 45 is removed or when the bait money is re-inserted, $t_2$. In FIG. 6*c*, the two timing diagrams are drawn together showing the time delay, $\Delta t$, between the time the drawer tray 45 or the bait money is removed, $t_1$, and activation of the switch to close the circuit, $t_2$. The time difference $\Delta t$, although small, may be enough to activate the remote alarm.

The delay circuit 73, however, prevents immediate activation of the remote alarm system by providing a three to seven second adjustable delay. In addition, this gives the employee time to reset the bait money back into the money clip 59 if the bait money was removed accidentally. When the drawer tray is removed, the delay circuit 73 provides time for the switching mechanism (magnetically activated switching half 65*b*) to close providing an alternative closed electrical path from the remote alarm system to the drawer housing 41. The timing diagram with a delaying circuit 73 is shown in FIG. 6*d*. The time delay relay used is manufactured by National Controls Corporation, 931 DuPage Avenue, Lombard, Ill. 60148. The part number is T3K-0060-466, 12 V dc. An equivalent part may be substituted.

The cashier's drawer shown in FIGS. 1–3 may also include a shorting feed through spring contact block device 53 in place of the non-shorting feed through spring contact block device 55. The shorting feed through spring contact block device 53 includes two separated contact springs 53*a* and 53*b*, two terminals 53*c* and 53*d*, and a shorting conductor 53*f* mounted in the space between the two separated contact springs 53*a* and 53*b*. A perspective view of the shorting feed through spring contact block device 53 is shown in FIG. 7*b*.

In the embodiment of the instant invention shown in FIG. 1, when the drawer tray 45 is removed from the drawer housing 41 the non-shorting feed through spring contact block device 55 opens, activating the remote alarm system. In the embodiment in FIG. 2, a push button switch 57 was included to provide an alternative closed electrical path from the remote alarm to the drawer housing 41 once the drawer tray 45 has been removed. In the embodiment in FIG. 3, a magnetic switch 65 served the same purpose. An alternative solution is the shorting feed through spring contact block device 53. When the drawer tray 45 is removed from the drawer housing 41 the separated contact springs 53*a* and 53*b* which were pushed downward into the floor 43*a* of the false bottom 43 and away from the shorting conductor 53*f* by the drawer tray 45 now extends upward to make contact with the shorting conductor 53*f*, which closes the electrical path from the remote alarm system to the drawer housing 41 preventing activation of the remote alarm. Although with the shorting feed through spring contact block device 53, neither the push button switch 57 shown in FIG. 2 nor the magnetic switch 65 shown in FIG. 3 are needed, they can be used together to increase reliability. The delaying circuit 73 again compensates for any delay in closing the electrical path.

Although the present invention and its advantages have been described in detail, it should be understood that various changes, substitutions and alterations can be made herein without departing from the spirit and scope of the invention as defined by the appended claims.

What is claimed is:

1. A money drawer assembly adapted to be coupled to an alerting means comprising:

a drawer housing;

a connection means on said drawer housing for coupling to said alerting means;

a drawer tray removably mounted to said drawer housing, said drawer tray having a drawer tray bottom;

a money clip attached to said drawer tray including a switch in a first state when bills are in said money clip and in a second state upon removal of said bills; and an electrical coupling means coupled to said money clip at one end and coupled to said connection means at a second opposite end, said electrical coupling means includes a first contact means mounted to said drawer tray mating with a second contact means mounted to said drawer housing when said drawer tray is mounted in said drawer housing.

2. The money drawer assembly of claim 1 further comprising second electrical coupling means coupled across said second contact means on said drawer housing and responsive to said drawer tray being removed from said drawer housing for providing an electrical path thereacross not passing through said money clip when said drawer tray is removed from said drawer housing thereby preventing false alarms when said drawer tray is removed.

3. The money drawer assembly of claim 1 wherein said first contact means includes a terminal contact device mounted to said drawer tray bottom having a pair of separated contact elements and said second contact means includes a non-shorting feed through spring contact device having a pair of separated contact springs, said non-shorting feed through spring contact device being operable to provide a first electrical path through said drawer tray and said drawer housing when said drawer tray is mounted in said drawer housing and said pair of separated contact elements of said terminal contact device are in contact with said pair of separated contact springs of said non-shorting feed through spring contact device and said separated contact springs are depressed and being operable to disconnect said first electrical path through said drawer tray and said drawer housing when said drawer tray is removed from said drawer housing and said pair of separated contact elements of said terminal contact device are not in contact with said pair of separated contact springs of said non-shorting feed through spring contact device allowing said pair of separated contact springs to extend.

4. The money drawer assembly of claim 3 further comprising second electrical coupling means coupled across said non-shorting feed through spring contact device on said drawer housing and responsive to removal of said drawer tray from said drawer housing for providing a second electrical path across said non-shorting feed through spring contact device not including said money clip to thereby prevent false alarms when said drawer tray is removed.

5. The money drawer assembly of claim 4 wherein said second electrical coupling means includes a push button switch mounted to said drawer housing and coupled to said non-shorting feed through spring contact device said push button switch being normally depressed when said drawer tray is mounted on said drawer housing and said push button switch being operable to extend to provide said second electrical path when said drawer tray is removed from said drawer housing.

6. The money drawer assembly of claim 4 wherein said second electrical coupling means includes a magnetically operable switch, said magnetically operable switch including:

a magnet half mounted to said drawer tray bottom; and a magnetically activated switching half mounted to said drawer housing and coupled to said non-shorting feed through spring contact device, said magnetically activated switching half being operable to provide said second electrical path between said drawer housing and said connecting means when said drawer tray is removed from said drawer housing and said magnet half is no longer touching or providing a strong magnetic field to said magnetically activated switching half.

7. The money drawer assembly of claim 1 wherein said first contact means includes a terminal contact device mounted to said drawer tray having a pair of separated contact elements and said second contact means includes a shorting feed through spring contact device connected to said drawer housing having a pair of separated contact springs and a shorting conductor coupling said pair of separated contact springs together when said pair of separated contact springs are not compressed, said shorting feed through spring contact device being operable to provide a first electrical path through said drawer tray and said drawer housing when said drawer tray is mounted in said drawer housing and said pair of separated contact elements of said terminal contact device are in contact with said pair of separated contact springs of said shorting feed through spring contact device and said pair of separated contact springs are depressed and being operable to provide a second electrical path across said pair of separated contact springs and said connection means when said drawer tray is removed from said drawer housing by allowing said pair of separated contact springs to extend and contact said shorting conductor thereby preventing false alarms when said drawer tray is removed.

8. The money drawer assembly of claim 1 further comprising delaying means coupled between said connection means and said alerting means for preventing immediate activation of said alerting means when said drawer tray is removed from said drawer housing.

9. The money drawer assembly of claim 8 wherein said delaying means includes a delay circuit, said delay circuit being operable to provide a three to seven second adjustable delay from the removal of said drawer tray from said drawer housing or from the removal of said bills from said money clip to the activation of said alerting means.

10. The money drawer assembly of claim 1 further comprising alignment means coupled between said drawer tray and said drawer housing to ensure proper alignment of said first contact means and said second contact means.

11. The money drawer assembly of claim 10 wherein said alignment means includes said drawer tray having a plurality of guidepin holes along said drawer tray bottom and a plurality of guidepins mounted to said drawer housing fitting within said guidepin holes along said drawer tray bottom.

12. A money drawer assembly adapted to be coupled to an alerting means comprising:

a drawer housing having a drawer housing floor;

a connection means on said drawer housing for coupling to said alerting means;

a false bottom spaced from said drawer housing floor;

a drawer tray removably mounted on said false bottom of said drawer housing, said drawer tray having a drawer tray bottom;

a bill tray positioned in said drawer tray, said bill tray having a bill tray floor and a cut-out portion in said bill tray floor;

a money clip attached to said drawer tray and protruding through said cut-out portion in said bill tray floor, said money clip including a switch in a first state when bills are in said money clip and in a second state upon removal of said bills; and electrical coupling means coupled to said money clip at one end and coupled to said connection means at a second opposite end, said electrical coupling means including a first contact means mounted to said drawer tray mating with a second contact means mounted to said false bottom of said drawer housing when said drawer tray is mounted in said drawer housing on said false bottom.

13. The money drawer assembly of claim 12 further comprising second electrical coupling means coupled across said second contact means on said drawer housing and responsive to said drawer tray being removed from said drawer housing for providing an electrical path thereacross not passing through said money clip when said drawer tray is removed from said false bottom of said drawer housing thereby preventing false alarms when said drawer tray is removed.

14. The money drawer assembly of claim 12 wherein said first contact means includes a terminal contact device mounted to said drawer tray bottom having a pair of separated contact elements and said second contact means includes a non-shorting feed through spring contact device mounted to said false bottom of said drawer housing having a pair of separated contact springs, said non-shorting feed through spring contact device being operable to provide a first electrical path through said drawer tray and said drawer housing when said drawer tray is mounted on said false bottom of said drawer housing and said pair of separated contact elements of said terminal contact device are in contact with said pair of separated contact springs of said non-shorting feed through spring contact device and said pair of separated contact springs are depressed and being operable to disconnect said first electrical path through said drawer tray and said false bottom when said drawer tray is removed from said false bottom of said drawer housing and said pair of separated contact elements of said terminal contact device are not in contact with said pair of separated contact springs of said non-shorting feed through spring contact device allowing said pair of separated contact springs to extend.

15. The money drawer assembly of claim 14 further comprising second electrical coupling means coupled across said non-shorting feed through spring contact device on said drawer housing and responsive to removal of said drawer tray from said drawer housing for providing a second electrical path across said non-shorting feed through spring contact device not including said money clip to thereby prevent false alarms when said drawer tray is removed.

16. The money drawer assembly of claim 15 wherein said second electrical coupling means includes a push button switch mounted to said false bottom of said drawer housing and coupled to said non-shorting feed through spring contact device said push button switch being normally depressed when said drawer tray is mounted on said false bottom of said drawer housing and said push button switch being operable to extend to provide said second electrical path when said drawer tray is removed from said drawer housing.

17. The money drawer assembly of claim 15 wherein said second electrical coupling means includes a magnetically operable switch, said magnetically operable switch including:

a magnet half mounted to said drawer tray bottom; and a magnetically activated switching half mounted to said false bottom of said drawer housing and coupled to said non-shorting feed through spring contact device, said magnetically activated switching half being operable to provide said second electrical path between said drawer housing and said connection means when said drawer tray is removed from said drawer housing and said magnet half is no longer touching or providing a strong magnetic field to said magnetically activated switching half.

18. The money drawer assembly of claim 12 wherein said first contact means includes a terminal contact device mounted to said drawer tray bottom having a pair of separated contact elements and said second contact means includes a shorting feed through spring contact device having a pair of separated contact springs and a shorting conductor mounted to said false bottom of said drawer housing, said shorting feed through spring contact device being operable to provide a first electrical path through said drawer tray and said drawer housing when said drawer tray is mounted on said false bottom of said drawer housing and said pair of separated contact elements of said terminal contact device are in contact with said pair of separated contact springs of said shorting feed through spring contact device and said pair of separated contact springs are depressed and being operable to provide a second electrical path across said pair of separated contact springs and said connection means when said drawer tray is removed from said false bottom of said drawer housing by allowing said pair of separating contact springs to extend and contact said shorting conductor thereby preventing false alarms when said drawer tray is removed.

19. The money drawer assembly of claim 12 further comprising delaying means coupled between said connection means and said alerting means for preventing immediate activation of said alerting means when said drawer tray is removed from said false bottom of said drawer housing.

20. The money drawer assembly of claim 19 wherein said delaying means includes a delay circuit, said delay circuit being operable to provide a three to seven second adjustable delay from the removal of said drawer tray from said false bottom of said drawer housing or from the removal of said bills from said money clip to the activation of said alerting means.

21. The money drawer assembly of claim 12 further comprising alignment means coupled between said drawer tray and said false bottom of said drawer housing for ensuring proper alignment of said first contact means and said second contact means.

22. The money drawer assembly of claim 21 wherein said alignment means includes said drawer tray having a plurality of guidepin holes along said drawer tray bottom and a plurality of guidepins mounted to said false bottom of said drawer housing fitting within said guidepin holes along said drawer tray bottom.

23. A money drawer assembly adapted to be coupled to an alerting means comprising:

a drawer housing having a drawer housing floor;

a connection means on said drawer housing for coupling to said alerting means;

a false bottom spaced from said drawer housing floor;

a drawer tray removably mounted on said false bottom of said drawer housing, said drawer tray having a drawer tray bottom;

a first bill/coin tray positioned in said drawer tray;

a second bill/coin tray positioned in said drawer tray beside said first bill/coin tray, one of said first bill/coin tray or said second bill/coin tray having a bill/coin tray floor and a cut-out portion in said bill/coin tray floor;

a money clip mounted to said drawer tray and protruding through said cut-out portion in said bill/coin tray floor, said money clip including a switch in a first state when bills are in said money clip and in a second state upon removal of said bills; and electrical coupling means coupled to said money clip at one end and coupled to said connection means at a second opposite end, said electrical coupling means including a first contact means mounted to said drawer tray mating with a second contact means mounted to said false bottom of said drawer housing when said drawer tray is mounted in said drawer housing on said false bottom.

24. A money clip alarm system comprising:

an alerting means;

a drawer housing;

a drawer tray removably mounted to said drawer housing;

a money clip attached to said drawer tray; and an electrical coupling means coupled to said money clip at one end and coupled to said alerting means at a second opposite end, said electrical coupling means including a first contact means in said drawer tray mating with a second contact means in said drawer housing when said drawer tray is mounted in said drawer housing.

* * * * *